US009028268B2

(12) United States Patent
Hsu

(10) Patent No.: US 9,028,268 B2
(45) **Date of Patent: *May 12, 2015**

(54) ELECTRICAL CONNECTOR

(71) Applicant: Yong Tai Electronic (DONG GUAN) Ltd., Dongguan (CN)

(72) Inventor: Ching-Jen Hsu, Dongguan (CN)

(73) Assignee: Yong Tai Electronic (DONG GUAN) Ltd., Dongguan, Guangdong (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/313,844

(22) Filed: Jun. 24, 2014

(65) Prior Publication Data

US 2014/0308845 A1 Oct. 16, 2014

Related U.S. Application Data

(63) Continuation of application No. 13/439,201, filed on Apr. 4, 2012, now Pat. No. 8,794,992.

(51) Int. Cl.

| | |
|---|---|
| ***H01R 13/627*** | (2006.01) |
| ***H01R 13/52*** | (2006.01) |
| ***H01R 13/6582*** | (2011.01) |
| ***H01R 13/6592*** | (2011.01) |
| *H01R 13/405* | (2006.01) |

(52) U.S. Cl.

CPC ..... *H01R 13/5213* (2013.01); *H01R 13/405* (2013.01); *H01R 13/6582* (2013.01); *H01R 13/6592* (2013.01)

(58) Field of Classification Search

CPC ..... H01R 13/5213
USPC ..... 439/353, 492, 499, 607.54–607.56, 660
See application file for complete search history.

(56) References Cited

U.S. PATENT DOCUMENTS

| | | | |
|---|---|---|---|
| 7,033,218 | B2 | 4/2006 | Huang et al. |
| 7,198,522 | B1 | 4/2007 | Ho et al. |
| 8,197,281 | B2 | 6/2012 | Yang |

*Primary Examiner* — Khiem Nguyen

(74) *Attorney, Agent, or Firm* — Edward C. Kwok; Steven P. Chen; Hogan Lovells US LLP

(57) ABSTRACT

An electrical connector comprising: a shell, zinc alloy shell, body, front rubber core, rubber plug and wire; said zinc alloy shell body is provided with a holding groove penetrating from the front to rear ends; the front rubber core and the rubber plug are installed inside the zinc alloy shell body, and the shell set externally onto the zinc alloy shell body; the electric connector is provided with a hook unit, which penetrates the front rubber core, and is also coupled with the zinc alloy shell body; at the rear end of said hook unit, a locating part is molded, and also locked at the threading section of the wire. Compared with prior arts, the utility model features excellent air-tightness, anti-EMI capacity and compactness, thus improving the signal transmission capacity of the electric connector.

4 Claims, 5 Drawing Sheets

ELECTRICAL CONNECTOR

RELATED APPLICATION

The present invention is a continuation of U.S. patent application Ser. No. 13/439,201 filed Apr. 4, 2012, which is incorporated herein in its entirety by reference.

BACKGROUND OF INVENTION

1. Field of the Invention

The present invention relates generally to an electrical connector, and more particularly to an innovative one.

2. Description of Related Art

In existing technologies, an electrical connector structurally comprises a front rubber core, rubber plug, front shell body, rear shell body composed of upper and lower shell bodies as well as wire; the upper and lower shell bodies are spliced or lock jointed, and set at rear end of the front shell body; the front rubber core is set within the front shell body, while the rubber plug is installed in a holding space formed by the rear shell body, and connected with the front shell body via two independent hooks.

According to the structure of said electrical connector, the front and rear shell bodies are not closely mated together, with a bigger clearance set between them; meanwhile, a bigger hole is reserved at the rear end of the rear shell body, leading to poorer air-tightness and anti-EMI capacity of entire shell body of the electric connector, thus affecting seriously the performance of the electric connectors; these two hooks are independently connected, presenting poorer connecting stability and air-tightness.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

SUMMARY OF THE INVENTION

The objective of the present invention is to avoid the shortcomings of prior arts by providing a compact electrical connector featuring excellent air-tightness and anti-EMI capacity.

To this end, the electrical connector of the present invention comprises: a shell, zinc alloy shell body, front rubber core, rubber plug and wire; said zinc alloy shell body is provided with a holding groove penetrating from the front to rear ends; the front rubber core and the rubber plug are installed inside the zinc alloy shell body, and the shell set externally onto the zinc alloy shell body; the electric connector is provided with a hook unit, which penetrates the front rubber core, and is also coupled with the zinc alloy shell body; at the rear end of said hook unit, a locating part is molded, and also locked at the threading section of the wire.

Of which, said hook unit consists of a horizontal substrate and two hook-shaped bodies extended separately along both sides of the substrate; the locating part is vertically arranged at the rear end edge of the substrate; a first and second sealing ends are formed separately at both sides of the locating part along the rear end edge of the substrate; the first and second sealing ends are flushed, and interlocked with the rear end of the front rubber core.

Of which, the hook unit is provided with a connecting hook, and the front rubber core provided with lugs, of which the connecting hook and lugs are interlocked.

Of which, the top edges of the first and second sealing ends of the hook unit are separately extended to form the connecting hooks.

Of which, an oblique block is set on the lower end surface of the substrate of the hook unit, and a window is set on the zinc alloy shell body, of which the oblique block and window are interlocked.

Of which, the locating part consists of a first locating part and a second locating part, of which the first locating part is connected with the first sealing end, and the second locating part connected with the second sealing end.

Of which, a spacing is set between the first and the second locating parts.

Of which, said hook unit is prefabricated.

Of which, said locating part is set at the middle part on the rear end of the substrate.

Of which, said zinc alloy shell body is prefabricated.

The electric connector of the present invention comprises: a shell, zinc alloy shell body, front rubber core, rubber plug and wire; said zinc alloy shell body is provided with a holding groove penetrating from the front to rear ends; the front rubber core and the rubber plug are installed inside the zinc alloy shell body, and the shell set externally onto the zinc alloy shell body; the electric connector is provided with a hook unit, which penetrates the front rubber core, and is also coupled with the zinc alloy shell body; at the rear end of said hook unit, a locating part is molded, and also locked at the threading section of the wire. Compared with prior arts, the utility model features excellent air-tightness, anti-EMI capacity and compactness, thus improving the signal transmission capacity of the electric connector and saving the cost.

DETAILED DESCRIPTION OF THE INVENTION

Preferred Embodiment 1

Figure 1:
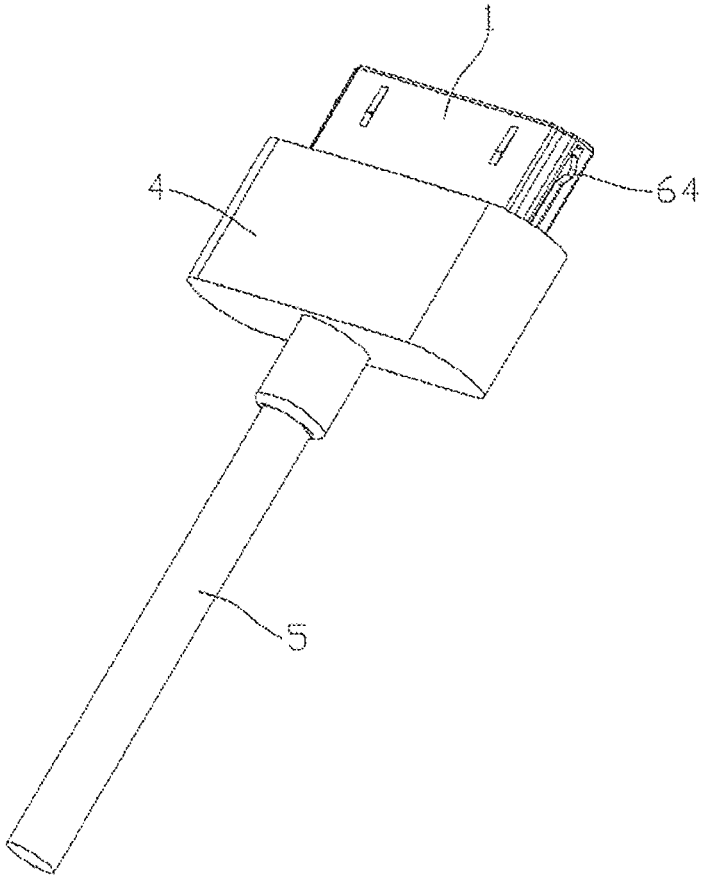
FIG. 1: a structural view of an electric connector of the present invention.
Figure 2:
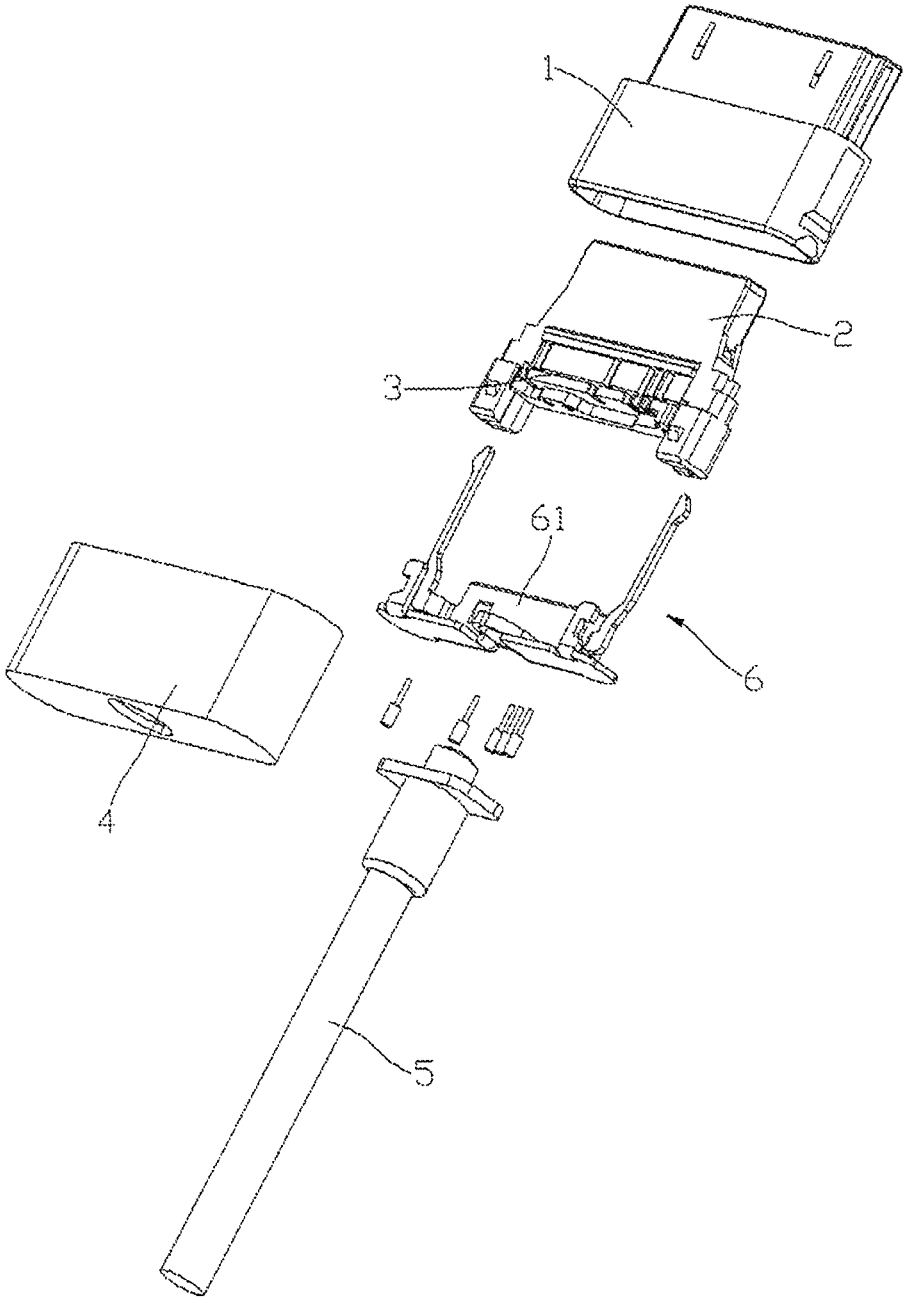
FIG. 2: an exploded structural view of an electric connector of the present invention.
Figure 3:
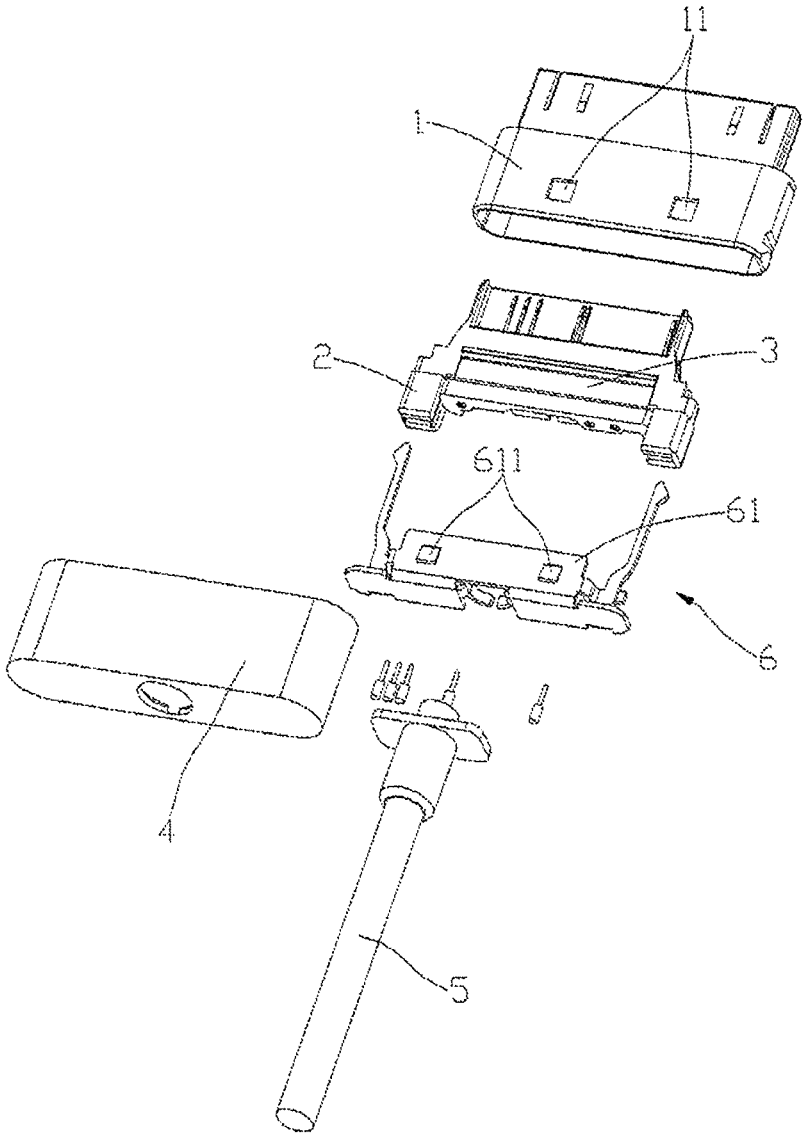
FIG. 3: an exploded structural view from another viewing angle of an electric connector of the present invention.

FIGS. 1-3 depict the first embodiment of an electric connector of the present invention, which comprising: a shell 4, a zinc alloy shell body 1, a front rubber core 2, a rubber plug 3 and wire 5. The zinc alloy shell body 1 is provided with a holding groove penetrating from the front to rear ends; the front rubber core 2 and the rubber plug 3 are installed inside the zinc alloy shell body 1, and the shell 4 set externally onto the zinc alloy shell body 1. The aforementioned technological characteristics are the same with those of the electric connector in prior arts. Besides, the electric connector of the present invention has other basic structures in prior arts.

The improvements of the present invention lie in that, the electrical connector is provided with a hook unit 6, which penetrates the front rubber core 2, and is also coupled with the zinc alloy shell body 1. At the rear end of the hook unit, a locating part 62 is molded, and also locked at the threading section of the wire 5. Compared with prior arts, the present invention differentiates itself by using a hook unit instead of two independent hooks; moreover, a locating part 62 is set on hook unit 6. With locking of the locating part 62 and the threading section of the wire 5, the threading hole for the wire 5 is reduced, thus enhancing air-tightness and anti-EMI capacity, and promoting the signal transmission capacity of the electric connector. Meanwhile, a locating part 62 is added to the hook unit 6, presenting simple construction and convenience in manufacturing and assembly. The zinc alloy shell body 1 and the hook unit 6 are closely coupled for stronger structural strength and compactness, making it not vulnerable to deformation under external forces.

In detail, the hook unit 6 is prefabricated by stainless steel or other materials. Due to strong structural strength, the hook unit 6 can be easily manufactured and assembled into a compact electric connector.

In detail, the locating part 62 is set at the middle part on the rear end of the substrate 61, and interlocked and mated with the threading section of the wire 5.

In detail, the zinc alloy shell body 1 is of a prefabricated type. With use of the zinc alloy shell body 1, this has solved the problems in prior arts that the front and rear shell bodies are not closely mated, and a bigger clearance is still reserved between them. The present invention features excellent air-tightness and anti-EMI capacity as well as cost-effectiveness and ease-of-assembly.

Preferred Embodiment 2

Figure 4:
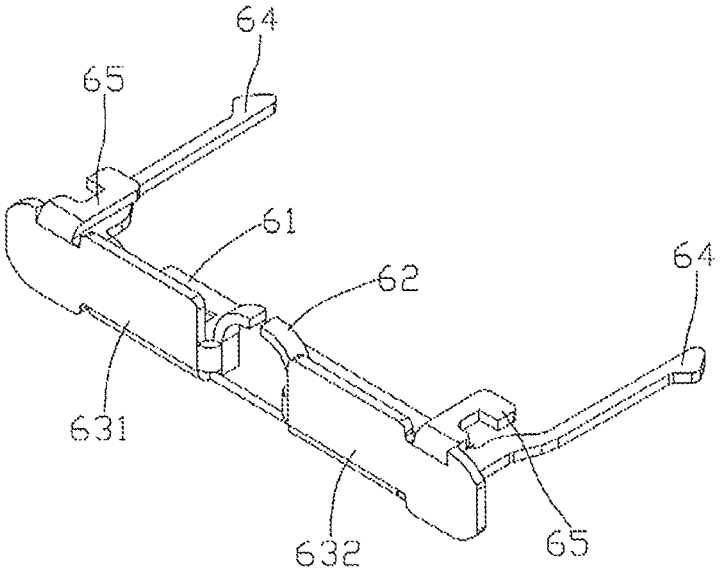
FIG. 4: a structural view of a hook unit of an electric connector of the present invention.
Figure 5:
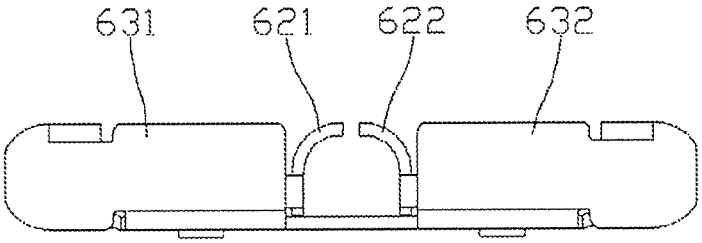
FIG. 5: a structural view from another viewing angle of a hook unit of an electric connector of the present invention.
Figure 6:
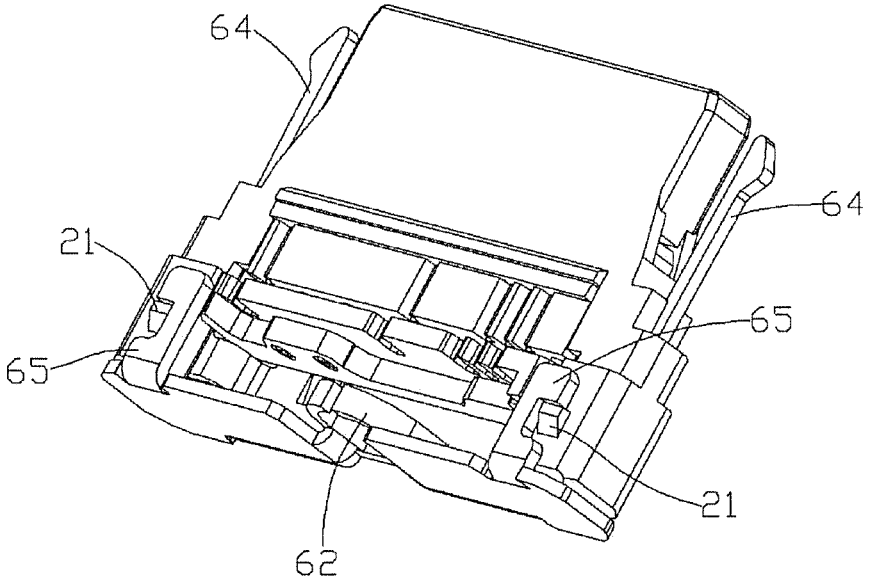
FIG. 6: a structural view of the present invention that the electric connector's hook unit is coupled with the front rubber core.

FIGS. 4-6 depict the second embodiment of an electric connector of the present invention. The technical scheme of the preferred embodiment 2 is the same with that of the preferred embodiment 1, and the characteristics not described herein are already explained in the preferred embodiment 1. The difference between preferred embodiments 1 and 2 lies in that: the hook unit 6 consists of a horizontal substrate 61 and two hook-shaped bodies 64 extended separately along both sides of the substrate 61; the locating part 62 is vertically arranged at the rear end edge of the substrate 61; a first sealing end 631 and a second sealing end 632 are formed separately at both sides of the locating part 62 along the rear end edge of the substrate 61; the first sealing end 631 and second sealing end 632 are flushed, and interlocked with the rear end of the front rubber core 2.

In detail, the hook unit 6 is provided with a connecting hook 65, and the front rubber core 2 provided with lugs 21, of which the connecting hook 65 and lugs 21 are interlocked. The connecting hook 65 is of "concave" shape, with its central groove used for interlocking with the lugs 21.

In detail, the top edges of the first and second sealing ends 631, 632 of the hook unit 6 are separately extended to form the connecting hooks 65. Correspondingly, the front rubber core 2 is provided with two lugs 21 interlocked with the connecting hooks 65.

In detail, an oblique block 611 is set on the lower end surface of the substrate 61 of the hook unit 6, and a window 11 is set on the zinc alloy shell body 1, of which the oblique block 611 and window 11 are interlocked.

In detail, the locating part 62 consists of a first locating part 621 and a second locating part 622, of which the first locating part 621 is connected with the first sealing end 631, and the second locating part 622 connected with the second sealing end 632. The arced first locating part 621 and the second locating part 622 form said locating part 62.

In detail, a spacing is set between the first locating part 621 and the second locating part 622. This allows the locating part 62 to fix securely the threading section of the wire 5 and also saves the materials for easier processing and manufacturing.

Preferred Embodiment 3

This is the third embodiment of an electric connector of the present invention. The technical scheme of the preferred embodiment 3 is the same with that of the preferred embodiment 2, and the characteristics not described herein are already explained in the preferred embodiment 2. The difference between preferred embodiments 3 and 2 lies in that: the spacing between the first locating part 621 and the second locating part 622 is smaller than or equal to the radius of the wire 5. This allows the locating part 62 to fix securely the threading section of the wire 5 and also saves the materials for easier processing and manufacturing.

The invention claimed is:

1. An electrical connector, which comprising: a shell, a die-casting shell body made of zinc alloy, front rubber core, rubber plug, a hook unit and wire; said shell body is provided with a holding groove penetrating from the front to rear ends; the front rubber core and the rubber plug are installed inside the shell body, and the shell set externally onto the shell body; the hook unit is adapted to penetrate the front rubber core, and is also coupled with the shell body, wherein the hook unit comprises a connecting hook, and the front rubber core comprises a lug such that the connecting hook and the lug are interlocked, and wherein at the rear end of the hook unit, a locating part is molded, and also locked at a threading section of the wire.

2. The electrical connector as claimed in claim 1, wherein the connecting hook is concaved shaped to interlock with the lug.

3. The electrical connector as claimed in claim 1, wherein the hook unit further comprises of a horizontal substrate; the locating part is vertically arranged at the rear end edge of the substrate; a first and second sealing ends are formed separately at both sides of the locating part along the rear end edge of the substrate; the first and second sealing ends are flushed, and interlocked with the rear end of the front rubber core.

4. The electrical connector as claimed in claim 3, wherein the locating part comprises a first locating part and a second locating part, wherein the first locating part is connected with the first sealing end, the second locating part connected with the second sealing end, and wherein a spacing between the first locating part and the second locating part is smaller than or equal to a radius of the wire.

* * * * *